US007228835B2

(12) United States Patent
Kokubo

(10) Patent No.: US 7,228,835 B2
(45) Date of Patent: Jun. 12, 2007

(54) OUTBOARD MOTOR

(75) Inventor: Koei Kokubo, Shizuoka-ken (JP)

(73) Assignee: Yamaha Marine Kabushiki Kaisha, Shizuoka-ken (JP)

( * ) Notice: Subject to any disclaimer, the term of this patent is extended or adjusted under 35 U.S.C. 154(b) by 0 days.

(21) Appl. No.: 11/108,029

(22) Filed: Apr. 15, 2005

(65) Prior Publication Data

US 2005/0229891 A1 Oct. 20, 2005

(30) Foreign Application Priority Data

Apr. 15, 2004 (JP) ..... 2004-120205

(51) Int. Cl.
*F02M 35/10* (2006.01)

(52) U.S. Cl. ..... 123/184.57

(58) Field of Classification Search ..... 123/184.57, 123/184.21, 184.61, 184.24, 184.34, 184.42, 123/585, 195 P
See application file for complete search history.

(56) References Cited

U.S. PATENT DOCUMENTS 6,446,599 B1 * 9/2002 Nakayasu ..... 123/339.23
6,499,473 B2 * 12/2002 Itoh ..... 123/585

FOREIGN PATENT DOCUMENTS

JP HEI 2001-152895 6/2001

* cited by examiner

*Primary Examiner*—Stephen K. Cronin
*Assistant Examiner*—Hyder Ali
(74) *Attorney, Agent, or Firm*—Knobbe, Martens, Olson & Bear, LLP

(57) ABSTRACT

An outboard motor has an air intake manifold with a plurality of intake runners and a surge tank. The runners extend from combustion chambers of an internal combustion engine to the surge tank. The air intake manifold is positioned next to one side of the internal combustion engine. An idle regulating valve supplies secondary air from the atmosphere to the air intake manifold. Secondary air flows into the idle regulating valve through an air intake port. The secondary air flows out of an air supply port of the idle regulating valve into the surge tank. The idle regulating valve is located in a space between the internal combustion engine and the air intake manifold, The air supply port of the idle regulating valve opens directly into the surge tank.

22 Claims, 4 Drawing Sheets

OUTBOARD MOTOR

PRIORITY INFORMATION

This application is based on and claims priority to Japanese Patent Application No. 2004-120205, filed Apr. 15, 2004, the entire contents of which is hereby expressly incorporated by reference.

BACKGROUND OF THE INVENTION

1. Field of the Invention

The present application generally relates to outboard motors, and more particularly to outboard motors with idle regulating valves for providing secondary air to an internal combustion engine of the outboard motor.

2. Description of the Related Art

Watercraft vehicles, such as boats, are often powered by an outboard motor having an internal combustion engine. The outboard motor may have an air intake system for controlling the amount of air delivered to the internal combustion engine. Japanese Patent Application HEI 2001-152895 discloses an outboard motor having a multi-cylinder internal combustion engine and an air intake manifold for delivering atmospheric air into the internal combustion engine. A throttle valve controls an opening of an intake passage in the air intake manifold thereby controlling the amount of primary air delivered into the engine's combustion chambers. An idle regulating system can supply secondary air to the engine via the intake passage to prevent stalling. The regulating system receives atmospheric air and then delivers the atmospheric air as secondary air through a bypass tube of the regulating system and into the intake passage of the air intake manifold.

A fuel injection system and the air intake manifold cooperate to control the air/fuel mixture delivered to combustion chambers. A throttle valve can be used to control the amount of air delivered to the internal combustion engine through the intake passage, and a fuel injection valve of the fuel injection system can control the amount of fuel supplied to the engine chambers. By controlling the amount of air and fuel delivered to the engine, a desired driving state (e.g., low engine speeds, high engine speeds, etc.) can be achieved.

When the watercraft is moving, the throttle valve of the outboard motor can be quickly closed in order to decelerate the watercraft. That is, the throttle valve can be closed to reduce the amount of secondary air delivered to the internal combustion engine, thereby reducing the engine speed and the outboard motor's power output. When the internal combustion engine speed is rapidly decelerated in this manner, the required amount of intake air to operate the engine is reduced. Nevertheless, conventional engines may deliver an insufficient amount of secondary air through the intake system to the internal combustion engine when the throttle valve is quickly closed and, thus, may result in stalling, for example.

When the throttle valve is quickly closed, a negative pressure in a surge tank of the engine may be significantly increased. Conventional engines may have a sensor to detect a negative pressure in the surge tank. When a relatively large, rapid increase of negative pressure is detected in the surge tank, the regulating valve can be opened to allow secondary air to flow into the surge tank to reduce the negative pressure. The secondary air is often delivered through the regulating valve, the bypass tube, and to the internal combustion engine. In this manner, when the throttle valve is rapidly closed, secondary air is delivered to the internal combustion engine to maintain operation of the engine. Thus, the secondary air delivered to the engine can prevent unintentional engine stalling. Unfortunately, conventional engines typically have regulating valves that undesirably increase the overall engine size. For example, conventional outboard motors may have idle regulating valves that are positioned above an internal combustion engine and an air intake manifold. Thus, the idle regulating valve increases the overall engine size. Additionally, a conventional outboard motor may have a complicated design with many parts, such as an idle regulating system comprising an idle regulating valve and an intake bypass tube, which provides communication between the intake passage in the air intake manifold and the idle regulating valve.

SUMMARY OF THE INVENTION

An aspect of the present invention disclosed herein includes the realization that the engine can be simplified and result in relatively small external dimensions. For example, an idle regulating valve can be positioned so that the overall external dimensions of the engine is reduced as compared to conventional engines.

Accordingly, one aspect of the present invention involves an outboard motor comprising a multiple cylinder internal combustion engine having combustion chambers. Each combustion chamber is defined by cylinder head, a piston, and a cylinder bore. An air intake manifold is configured to introduce both primary and secondary air from the atmosphere into the internal combustion engine. The air intake manifold has a plurality of intake runners that are located next to one side of the internal combustion engine and extends from the cylinder head to a surge tank. An idle regulating valve is arranged to supply secondary air from the atmosphere to the surge tank. The idle regulating valve comprises an air intake port that is configured to receive secondary air in an air supply port that is arranged to supply the secondary air from the idle regulating valve to the surge tank. At least the portion of the idle regulating valve is positioned in a space between the internal combustion engine and the air intake manifold. The air supply port of the idle regulating valve opens directly into the surge tank.

Another aspect of the present invention involves an outboard motor comprising an internal combustion engine. The engine includes an air intake system having an air intake manifold. The manifold includes a plurality of intake runners and a surge tank. The intake runners are positioned adjacent to the internal combustion engine and extend from the surge tank toward corresponding combustion chambers of the internal combustion engine. An idle regulating valve is in fluid communication with the air intake manifold. The idle regulating valve comprises an air intake port that is configured to receive secondary air and an air supply port that is arranged to deliver secondary air to the air intake manifold. At least a portion of the idle regulating valve lies interposed between the internal combustion engine and the air intake manifold.

BRIEF DESCRIPTION OF THE DRAWINGS

The above-mentioned and other features of the invention disclosed herein are described below with reference to the drawings of a preferred embodiment. The illustrated embodiment is intended to illustrate, but not to limit the invention. The drawings contain the following figures.

FIG. 4 illustrates the air intake system from a side opposite of that shown in FIG. 2, i.e., from an inner side.

DETAILED DESCRIPTION OF THE PREFERRED EMBODIMENT

Figure 1:
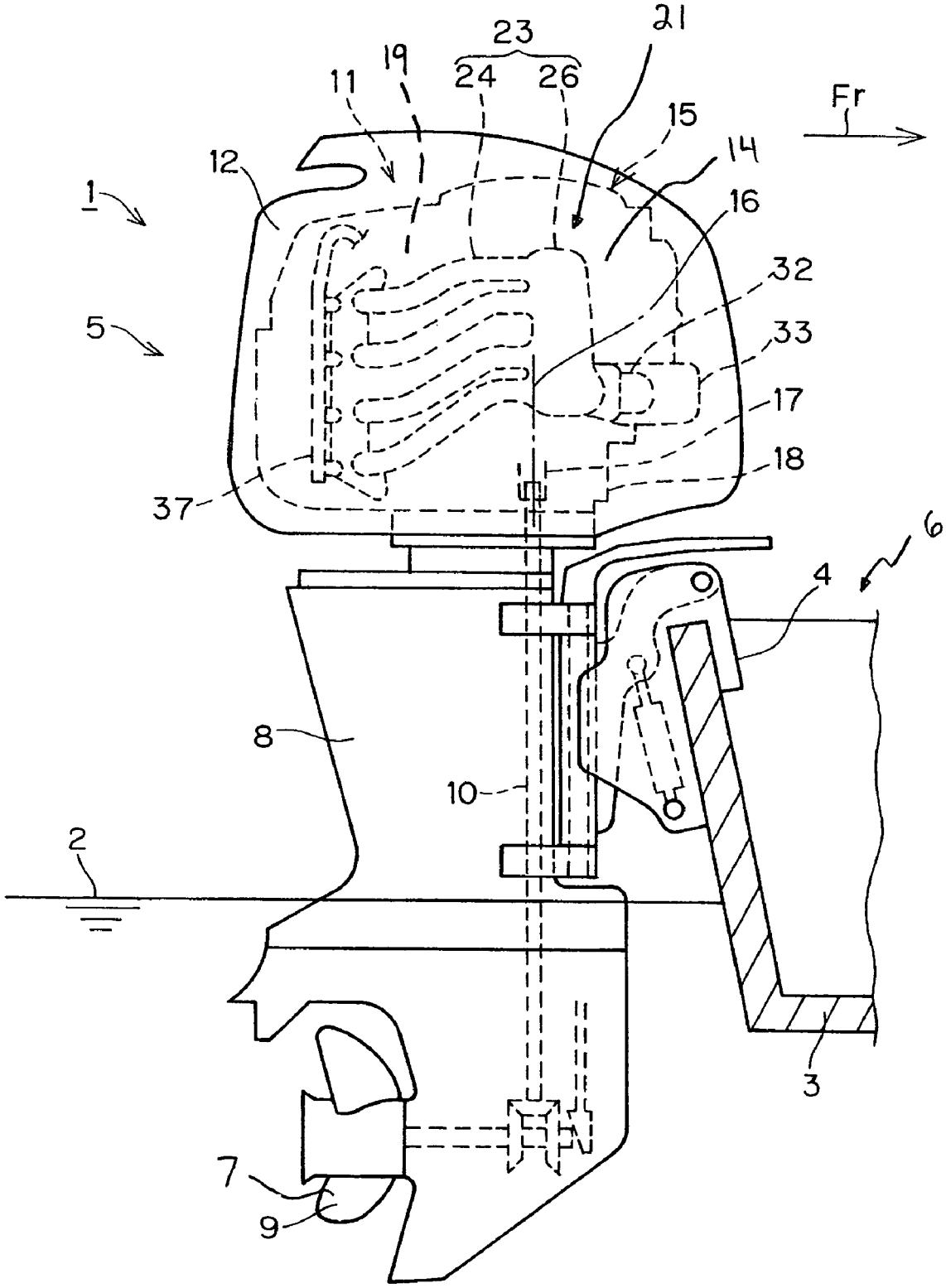
FIG. 1 is a side elevational view of an outboard motor configured in accordance with a preferred embodiment of the present invention. An associated watercraft, on which the outboard motor is mounted, is partially shown in section. Several of the internal components of the outboard motor are illustrated in phantom.

With reference to FIG. 1, a watercraft 1 has an outboard motor 5 that is configured in accordance with certain features, aspects, and advantages of the present invention. The outboard motor 5 is a typical marine drive, and thus all the embodiments below are described in the context of an outboard motor. The embodiments, however, can be applied to other marine drives, such as, for example, inboard drive and outboard drives (or stern drives), as will become apparent to those of ordinary skill in the art. The arrow FR in the drawing indicates the forward direction in which the watercraft 6 travels.

The watercraft 1 has a hull 3 floating in the water 2. The hull 3 carries the outboard motor 5, which has a propulsion unit 9 and an internal combustion engine 15 (shown in phantom). The engine 15 of the outboard motor 5 powers the propulsion unit 9. The illustrated propulsion unit 9 is a single propeller system; however, other types of propulsion units can be used as well, such as, for example, a dual counter-rotational propeller system, a jet drive, and the like. The outboard motor 5 is supported on the transom of the hull 3 by a clamp bracket 4 so as to place at least a portion of the propulsion unit 9 in a submerged position when the watercraft 1 rests in the water 2. The motor 5 is preferably steerable and/or tiltable by moving the clamp 4.

The upper portion of the outboard motor 5 includes a case 8 that is rotatably supported by the clamp bracket 4. A lower part of the case 8 is preferably located in the water 2. The propulsion unit 9 is rotatably supported by the lower end of the case 8 and preferably comprises a propeller 7.

A drive unit 11 is housed within the case 8 and is configured to drive the propulsion unit 9 via a transmission 10. A cowling 12 surrounds and protects the upper end of the drive unit 11. Preferably, the cowling 12 is detachably connected to the upper end of the case 8. Thus, the cowling 12 can be removed from the case 8 to expose the internal combustion engine 15 of the drive unit 11.

Figure 2:
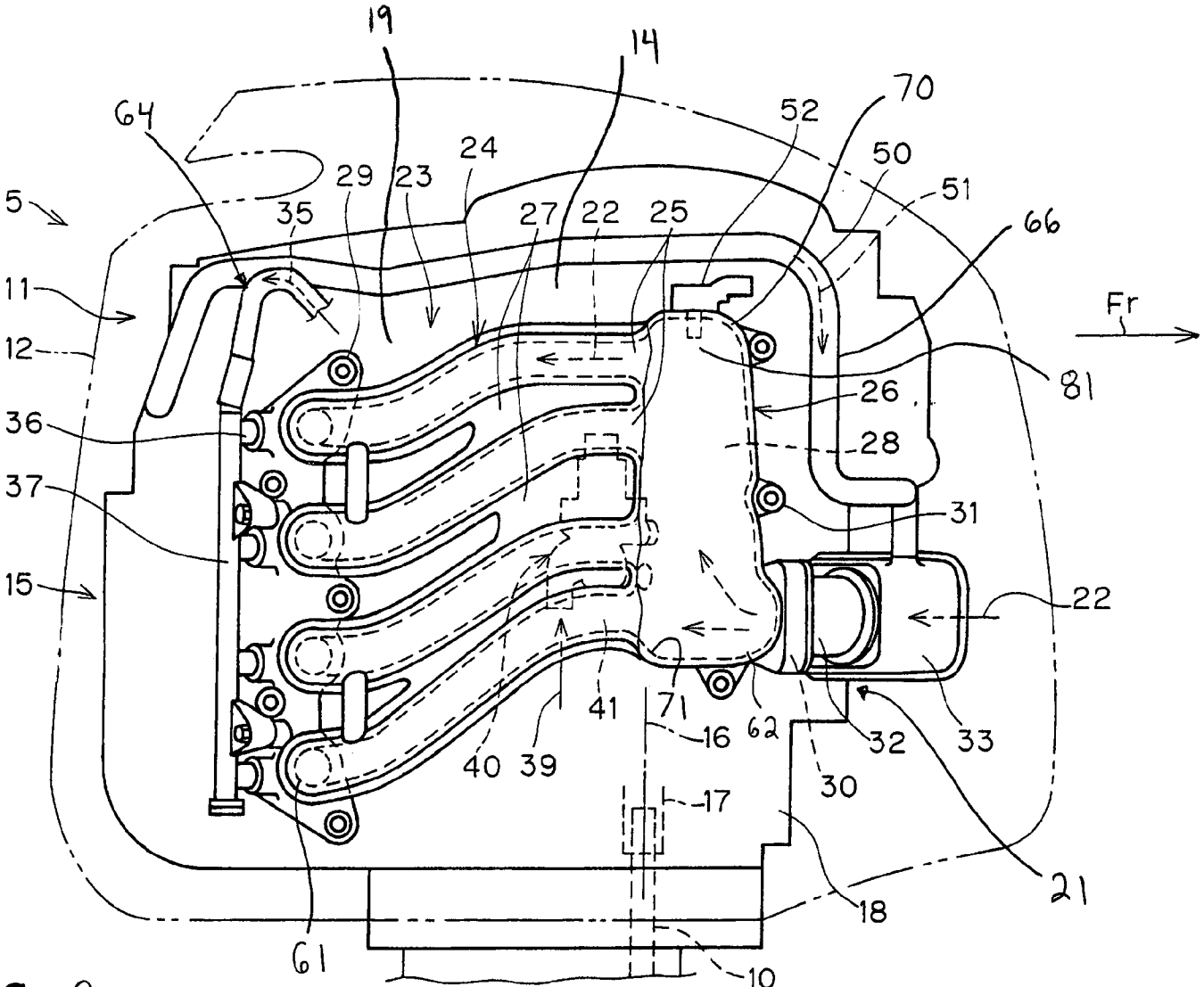
FIG. 2 is an enlarged side elevational view of a portion of the outboard motor of FIG. 1. A cowling and other components of the outboard motor are illustrated in phantom.

With reference to FIGS. 1 and 2, the illustrated drive unit 11 includes the internal combustion engine 15 which is preferably a multi-cylinder, four-cycle engine. Engines having a different number of cylinders, other cylinder arrangements, various cylinder orientations (e.g., upright cylinder banks, and V-type), and operating on various combustion principles (e.g., four stroke, crankcase compression two-stroke, diesel, and rotary) are all practicable for use with the air intake system disclosed herein. The engine 15 comprises an engine body 14 defining at least one cylinder bore therethrough. A cylinder head assembly is connected to the cylinder bore, and a piston is disposed within the cylinder bore. The cylinder bore, the cylinder head assembly, and the piston cooperate to define a variable combustion chamber 19. The illustrated engine 15 comprises four in-line cylinder chambers 19 that extend generally horizontally and that are generally vertically spaced above one another.

The illustrated engine 15 has a crankcase 18 that supports a crankshaft 17, which is preferably rotatable about a generally vertically oriented axis 16. The plurality of engine cylinder bores extend from the crankcase 18.

The outboard motor 5 preferably comprises an air intake system 21. The air intake system 21 draws air from outside the engine, preferably from within the cavity defined by the cowling 12 and the internal combustion 15, and delivers the air to the combustion chambers 19. The air intake system 21 comprises an air intake manifold 23, throttle valve 32, and a silencer 33. The air intake system 21 (FIG. 2) defines an airflow pathway for communication between the atmosphere and the inside of the chambers 19 of the internal combustion engine 15. The air intake system 21 can selectively control the amount of air delivered to the chambers 19 to achieve the desired engine operation.

With continued reference to FIGS. 1 and 2, the air intake manifold 23 is configured to deliver secondary air to one or more chambers 19 of the internal combustion engine 15. Generally, the air intake manifold 23 draws in primary air 22 (see FIG. 2), preferably atmospheric air, and delivers the air into the engine chambers 19. The illustrated air intake system 21 comprises a single air intake manifold 23 generally positioned on one side of the engine 15. However, the air intake system 21 can comprise a plurality of air intake manifolds and can be used to deliver air to V-type engines, for example.

Figure 3:
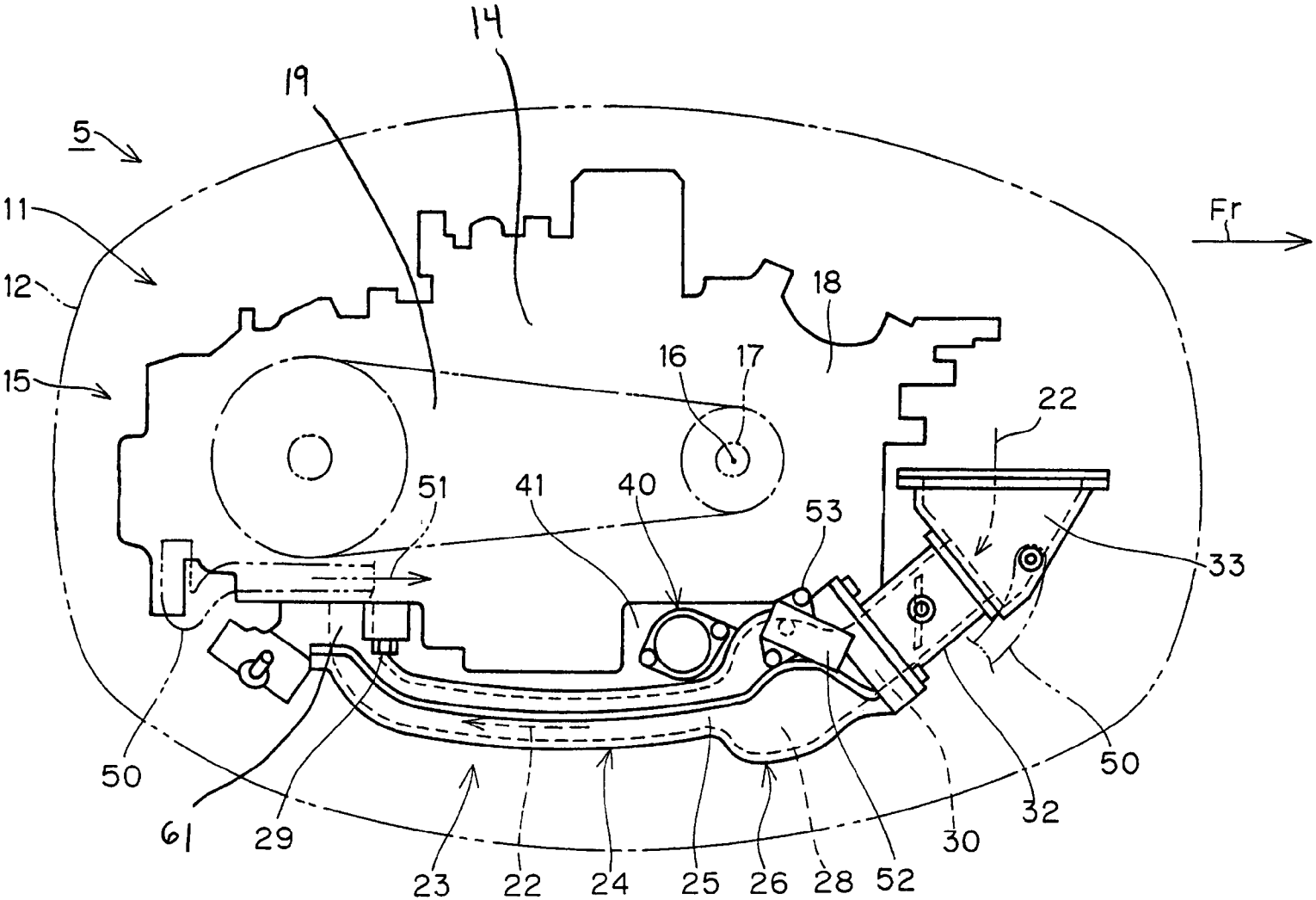
FIG. 3 is a top plan view of the outboard motor of FIG. 1. The cowling and other components of the outboard motor are illustrated in phantom.

The air intake manifold 23 comprises a plurality of runners or conduits 24 and a surge tank 26. The illustrated air intake manifold 23 includes a plurality of intake runners 24 positioned next to and extending along a side of the engine 15. The intake runners 24 provide communication between the surge tank 26 and the combustion chambers 19. Each of the intake runners 24 extends from the surge tank 26 to a corresponding cylinder of the engine 15. As shown in FIG. 2, each runner 24 has a downstream end 61 connected to the engine 15 and an upstream end 25 connected to the surge tank 26. The downstream ends 61 are preferably coupled to corresponding cylinder heads by one or more fasteners 29. In the illustrated embodiment, four intake runners 24 extend between the engine chambers and the surge tank 26 and are somewhat vertically disposed above one another, as shown in FIG. 3.

The downstream ends 61 of the runners 24 can be in communication with inner intake passages (not shown) of the cylinder heads of the engine 15. The inner intake passages can communicate with the combustion chambers 19 through intake ports, which are formed at inner surfaces of the cylinder head members. Typically, each of the combustion chambers has one or more intake ports. Intake valves can be disposed at each cylinder head and can be configured to move between an open position and close position. The intake valves selectively control the flow of air from the air intake system 21 into the cylinders of the combustion chamber.

In some embodiments, including the illustrated embodiment, the intake runners 24 are integrally formed with the surge tank 26. The surge tank 26 can reduce or limit surges (e.g., pulsations) of the air within the air intake manifold 23, e.g., the surges of the secondary air. The surge tank 26 preferably has an enlarged chamber 71, which permits expansion of the air therein to reduce pulsations. The illustrated surge tank 26 is an elongated tank that extends generally vertically between and connects together the intake runners 24.

The air intake system 21 can optionally comprise a runner support 27 that is configured to provide structural support to the air intake manifold 23, preferably to one or more of the runners 24. The illustrated runner support 27 is in a form of a reinforcing plate that is connected to each of the intake runners 24. Each adjacent pair of intake runners 24 can have a portion of the runner support 27 disposed therebetween. The runner support 27 securely holds the runners 24 in position during engine operation. The illustrated runner support 27 extends from the surge tank 26 along at least a substantial portion of each of the intake runners 24.

In some embodiments, the runner support 27 is a somewhat lightweight, rigid structure that extends from the surge tank 26 to the downstream end 61 of the intake runner 24. The runner support 27 can reduce or limit movement of the intake runners 24 during engine operation.

As shown in FIG. 2, the surge tank 26 is positioned next to the side of the crankcase 18. One or more fasteners 31 can be used to attach the surge tank 26 to the crankcase 18. The surge tank 26 has a lower front side 62 that defines a surge tank opening 30 configured to receive air. The air indicated by the arrows 22 can flow through the surge tank opening 30 and into the chamber 28 within the surge tank 26. The air 22 flows through the surge tank 26 towards the intake runners 24. The flow rate of the air 22 is decreased and the air tends to stagnate or flow at relatively low flow rates at the upper portion 81 of the chamber 28 in the surge tank 26.

With respect to FIGS. 2 and 3, the throttle valve 23 and a silencer 33 can cooperate to deliver primary air to the air intake manifold 23. In some embodiments, the throttle valve 23 and the silencer 33 can be positioned upstream of the surge tank 26. In the illustrated embodiment, at least portions of the throttle valve 32 and the silencer 33 are positioned forwardly of the surge tank 26. The external air 22 can pass through the silencer 33, the throttle valve 32, and into the surge tank 26. The air can flow through the surge tank 26 to intake runners 24 for delivery to the combustion chambers 19 of the engine 15.

The throttle valve 32 is interposed between the silencer 33 and the surge tank 26. The throttle valve 32 regulates the amount of air allowed to enter the surge tank 26 and ultimately into the intake runners 24. Air can be drawn through the silencer 33 and the throttle valve 32 and into the air intake manifold 23.

With respect to FIG. 2, the air intake system 21 and a fuel injection system 64 deliver air and fuel, respectively, to the combustion chambers 19 for the combustion process. In the illustrated embodiment, the fuel injection system 64 has a plurality of fuel injection valves 36 for delivering fuel, indicated by the arrow 35, to fuel injectors. The fuel injectors can be electrically operated and have solenoids for opening and closing injection valves so as to permit fuel to be sprayed into one or more ports leading into a corresponding combustion chamber. The fuel injection system 64 can have a fuel rail 37 that supplies the pressurized fuel 35 to the fuel injection valves 36. The fuel injection system 64 in some embodiments delivers fuel directly into the combustion chambers 19 of the engine 15.

Figure 4:
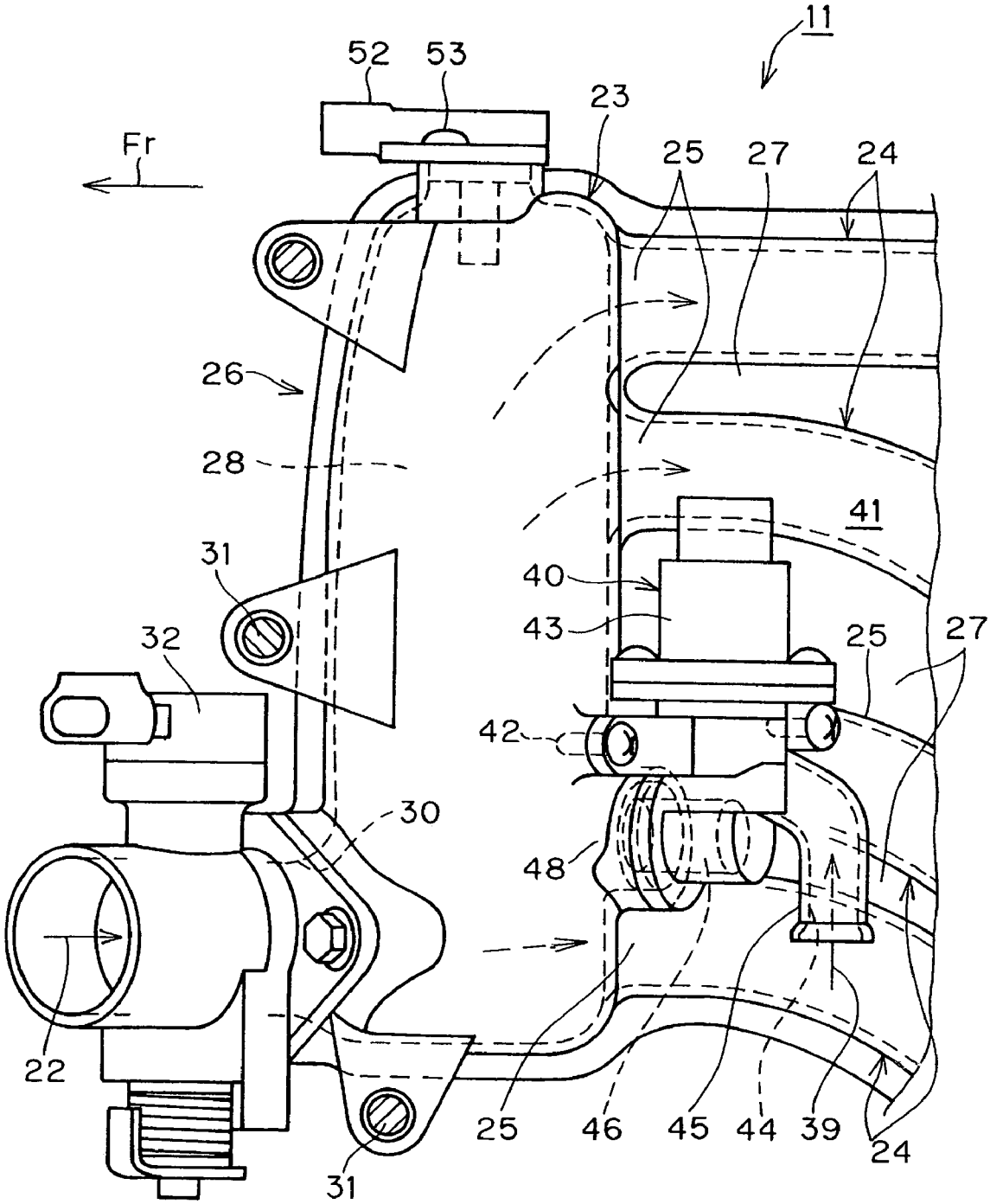
FIG. 4 is an enlarged side elevational view showing an air intake system of FIG. 1 removed from the engine 15.

As best seen in FIGS. 2–4, an idle regulating valve 40 is configured to provide secondary air 39 into the air intake system 21. The idle regulating valve 40 can be opened and closed to adjust the pressure within the air intake manifold 23 and to supplement the airflow into the surge tank 26 under at least some operating conditions. The idle regulating valve 40 can effectively regulate the secondary air pressure within the air intake system 21 to ensure that the engine 15 receives a sufficient amount of air to operate smoothly. Secondary air can be delivered into the air intake manifold 23 by the idle regulating valve 40 to adjust the pressure within the air intake manifold 23. Preferably, the idle regulating valve 40 delivers secondary air into the air intake manifold 23 at or near the surge tank 26 to ensure that the engine 15 can idle without stalling, for example.

As shown in FIGS. 2 and 3, at least a portion of the idle regulating valve 40 is located in a space 41 between the engine body 14 of the combustion engine 15 and the air intake manifold 23. The engine body 14 and the air intake manifold 23 extend upwardly and/or downwardly past the idle regulating valve 40. The widths of the intake runners 24, as viewed from above, are generally less than the width of the surge tank 26. The intake runners 24 and the surge tank 26 cooperate to form one side of the space 41 suitable for receiving the idle regulating valve 40, while the engine body 14 forms the other side of the space 41. The space 41 is sized and dimensioned to facilitate the installation of the idle regulating valve 40. By placing the idle regulating valve 40 in the space 41, the external dimensions of the outboard motor 5 can be smaller than the external dimensions of a conventional outboard motor in which an idle regulating valve is located above the internal combustion engine.

The idle regulating valve 40 is interposed between the air intake manifold 23 and the engine body 14. In the illustrated embodiment, the entire idle regulating valve 40 is positioned between the air intake manifold 23 and the engine body 14. However, the idle regulating valve 40 can extend from the space 41. For example, a portion of the idle regulating valve 40 can extend through a gap between a pair of runners 24, upwardly past the air intake manifold 23, and/or downwardly past the air intake manifold 23. Thus, at least a portion of the idle regulating valve 40 can protrude from the space 41. Preferably, a substantial portion of the idle regulating valve 40 is positioned within the space 41. The illustrated idle regulating valve 40 is positioned between the runners 24, the air intake manifold 23, and the engine 15. The internal combustion engine 15, air intake manifold 23, and the idle regulating valve 40 can cooperate to form a compact engine suitable for fitting within a relatively small cowling 12. Advantageously, the air intake manifold 23 can surround the idle regulating valve 40 to protect it from external forces and to reduce engine noise.

With respect to FIG. 4, the idle regulating valve 40 is configured to receive atmospheric air 39 and deliver air to the air intake manifold 23. The idle regulating valve 40 preferably comprises a valve body 43 and an air induction conduit 45 defining an air intake port 44. Generally, secondary air 39 can pass through an intake port 44 and through the induction conduit 45 to the valve body 43. The valve body 43 then delivers the air to an air supply port 46 that opens into the surge tank 26. In this manner, the idle regulating valve 40 can receive and deliver secondary air to the air intake manifold 23.

The idle regulating valve 40 is preferably supported by the air intake manifold 23 and/or the engine 15. In the illustrated embodiment, the valve body 43 is secured directly to the air intake manifold 23 by one or more fasteners 42, preferably by a pair of fasteners. In the illustrated embodiment, the valve body 43 of the idle regulating valve 40 is secured to the air intake manifold 23 by the one or more fasteners 42 that also connect the upstream ends 25 of the runners 24 to the surge tank 26.

The air supply port 46 of the valve body 43 is configured and positioned to deliver air 39 to the chamber 28 in the surge tank 26. In some embodiments, the air supply port 46 preferably opens directly into the chamber 28 in the surge tank 26, unlike conventional outboard engines that have an intake bypass tube for communicating between an idle regulating valve and an air intake manifold. The bypass tube of conventional engines may fail (e.g., leak air) and can further complicate engine design. The bypass tube also can restrict the air flow from the idle regulating valve and typically defines a relatively long flow path from the idle regulating valve to the air intake manifold. A conventional idle regulating valve can be opened and closed in response to control signals. When the idle regulating valve receives a signal and is opened, the secondary air has to flow along the long flow path of the restrictive bypass tube before entering the air intake manifold. The bypass tube therefore causes a delay when delivering the secondary air. Similarly, the bypass tube can cause a delayed effect when the idle regulating valve is closed because secondary air in the bypass tube can be drawn into the air intake manifold even after the idle regulating valve is closed. Advantageously, the illustrated outboard motor 5 does not have a bypass tube that can fail (e.g., break) and has a reduced number of parts as compared to some conventional engines. The supply port 46 can be integrally formed in the valve body 43 and can open directly into the chamber 28 in the surge tank 26. Because the secondary air does not have to travel along a long flow path and through a restrictive tube, the idle regulating valve 40 can quickly deliver secondary air to the air intake manifold 23. Similarly, the idle regulating valve 40 can abruptly reduce or substantially stop the flow of secondary air into the air intake manifold 23. The idle regulating valve 40 can therefore quickly control the flow of secondary air in response to a control signal.

The air induction conduit 45 preferably extends outwardly and downwardly from the valve body 43 and defines the air intake port 44 for receiving the secondary air 39. The illustrated air induction conduit 45 is generally L-shaped. The air intake port 44 preferably opens downwardly into the space 41 at some point between the engine 15 and the air intake manifold 23. As shown by the arrow 39 in FIG. 4, when the air induction valve 40 is opened, the secondary air 39 can pass through the intake port 44 and through the induction conduit 45 to the valve body 43 which, in turn, delivers the air 39 into the surge tank 26. The air flows through the surge tank 26 and into the runners 24 for delivery to the combustion chambers of the engine 15.

When the idle regulating valve 40 is opened, the air 39 generates noise as it is drawn from the atmosphere into the chamber 28 of the air intake manifold 23. Advantageously, because the air intake port 44 of the outboard motor 5 is positioned within the shielded space 41, at least some of the sound waves emitting from the opened idle regulating valve 40 can be blocked by the air intake manifold 23 and/or the engine 15, thus reducing the noise produced by outboard motor 5. In other words, the induction noise is muffled.

The air intake manifold 23 and/or engine 15 of the outboard motor 5 can block water droplets from entering the idle regulating valve 40, thereby improving engine performance. Furthermore, because the air intake port 44 extends downwardly, the transmission of noise from the idle regulating valve 40 and entrance of water droplets into the idle regulating valve 40 can be further reduced.

A further advantage is provided where the idle regulating valve 40 is positioned within the space 41, which typically exists in most conventional outboard motor engines. Thus, the idle regulating valve 40 can be installed without significantly increasing the overall external size of the conventional outboard motor and can be installed aftermarket.

With continued reference to FIG. 4, the idle regulating valve 40 is preferably positioned such that the secondary air 39 is delivered into one or more of the runners 24. The air supply port 46 is preferably formed in a mounting boss 48 of the surge tank 26 positioned between the upstream ends 25 of an adjacent pair of runners 24. In some embodiments, the air supply port 46 is formed at a mounting boss 48 near the upstream end opening 30 of the chamber 28. The mounting boss 48 can be located between the opening 30 and the lowest pair of runners 24. The illustrated mounting boss 48 extends into the space 41 and is connected to a lower portion the surge tank 26, as best seen in FIGS. 2 and 4. The illustrated mounting boss 48 of the surge tank 26 is positioned vertically between the upstream ends 25 of the lowest pair of runners 24.

Although the illustrated embodiment comprises a single idle regulating valve 40, a plurality of idle regulating valves 40 can be employed. For example, a plurality of idle regulating valves 40 can be disposed along the air intake manifold 23. Preferably, one or more of the idle regulating valves 40 are disposed between the surge tank 26 and the engine 15. Additionally, the idle regulating valve 40 can be positioned at other points along the air intake manifold 23. For example, the idle regulating valve 40 can be positioned at some point along one of the runners 24.

Optionally, one or more blow-by gas systems can provide communication between components of the outboard motor 5. A blow-by gas system 50 (FIG. 2) is configured to provide fluid communication between one or more chambers 19 and the air intake system 21, preferably via the silencer 33. In the illustrated embodiment of FIG. 2, the blow-by gas system 50 comprises a conduit 66 that defines a passageway that that extends from one or more of the cylinder heads to the silencer 33. Blow-by gas 51 generated in the combustion chambers 19 can be drawn into the conduit 66 and then delivered to the air intake system 21. The combustion gas passed through the blow-by gas system 50 is delivered through the silencer 33, the throttle valve 32, the air intake manifold 23 and is then redelivered to the combustion chambers and is, thus, prevented from being discharged into the atmosphere.

The outboard motor 5 can have one or more sensors 52 for measuring temperatures, pressures, and the like along the air intake system 21. As shown in FIGS. 2–4, the air intake system 21 includes a sensor 52 mounted to the air intake manifold 23, preferably to the surge tank 26. The sensor 52 measures the secondary air temperature and the intake pressure within the air intake manifold 23. The sensor 52 can be mounted to the upper portion 70 of the surge tank 26 by a fastener 53.

In the illustrated embodiment, the sensor 52 detects the intake negative pressure and temperature of the air in the surge tank 26. The air flowing near the sensor 52 may flow at a relatively low flow rate during engine operation. The sensor 52 can preferably detect the pressure and/or temperature with relatively high precision and produce detection signals that are received by the idle regulating valve 40. Thus, the idle regulating valve 40 can be accurately operated based on a detection signal from the sensor 52. The sensor 52 is preferably positioned above the opening 30. The sensor 52 can also be positioned above the uppermost runner 24. The illustrated sensor 52 is positioned along the top of the surge tank 26.

When blow-by gas is sucked into the surge tank 26, oil mist in the blow-by gas preferably generally does not reach the upper portion 81 of the chamber 28. Thus, the sensor 52 is generally not contaminated by oil mist in the blow-by gas passing through the chamber 28.

The performance of the sensor 52 can be maintained at various engine speeds. The idle regulating valve 40 can be opened and closed with precision based on a detection signal from the sensor 52 during a wide range of engine operating conditions, such as engine idling. Thus, engine stall and rough running can be inhibit. Although not illustrated, one or more detection sensors 52 can be positioned along the runners 24, the surge tank 26, or any other suitable position along the air intake manifold 23.

Based on the measurements of the sensor 52, the idle regulating valve 40 can be selectively controlled to adjust the airflow through the valve 40 and into the air intake manifold 23. That is, the signals from the sensor 52 are used to open and close the regulating valve 40 to achieve a desired secondary airflow to the air intake manifold 23. The idle regulating valve 40 can directly receive the signals from the sensor 52. Alternatively, the sensor 52 can indirectly communicate with the idle regulating valve 40. For example, an electronic control unit ("ECU") can receive a signal from the sensor 52 and can control the operation of the idle regulating valve 40 based at least in part on the signal received from the sensor 52. The regulating valve 40 can be electronically or mechanically operated to obtain the desired airflow to the air intake manifold 23. The idle regulating valve 40 can be operated between an open and closed position. Additionally, in some applications, the idle regulating valve 40 can also be operated between multiple positions to achieve various flow rates of secondary air through the valve 40 and into the surge tank 26. For example, the idle regulating valve 40 can have an opening that is adjustable to numerous positions (e.g., continuously variable) in order to precisely control the flow of secondary air to the air intake manifold 23.

In operation, the internal combustion engine 15 powers the propulsion unit 9 to cause rotation of the propulsion unit's propeller 7, thereby propelling the watercraft 1. The throttle valve 32 can selectively control the amount of air supplied to the internal combustion engine 15 through the air intake manifold 23. The operating condition of the internal combustion engine can be controlled by opening and closing of the throttle valve 32. When the throttle valve 32 is opened (e.g., fully opened), the idle regulating valve 40 can be closed so that secondary air 39 does not enter the air intake manifold 23.

When the secondary air 39 is supplied from the atmosphere through the air supply port 46 into the chamber 28 in the surge tank 26, the secondary air 39 is effectively added to the air 22 drawn into the chamber 28 through the upstream end opening 30. The combined air is flows through the intake runners 24 and is delivered to the combustion chambers 19 to achieve stable engine performance.

In some modes of operation, the idle regulating valve 40 can be in the closed position when the throttle valve 32 is opened. When the throttle valve 32 is rapidly closed (e.g., to decelerate the boat 1), the engine speed may be rapidly decelerated and the amount of intake air required for engine operation can be likewise decreased. Nevertheless, the amount of intake air 22 delivered to the internal combustion engine 15 through the chamber 28 may be insufficient for proper engine operation and can result in an increased intake negative pressure within the surge tank 26.

When the sensor 52 measures a predetermined increase in the intake negative pressure, the idle regulating valve 40 can be opened (e.g., partially or fully opened) in response to a signal sent from the sensor 52. When the regulating valve 40 is opened, secondary air 39 is supplied from the regulating valve 40 to the air intake manifold 23. The secondary air 39 reduces the negative pressure within the surge tank 26 and is then delivered to the engine 15. Advantageously, when the throttle valve 32 is closed, even quickly closed, a sufficient amount of secondary air is supplied to the internal combustion engine 15 to prevent undesirable rough running at low engine speeds or stalling. In other words, the air comprising the primary air 22 and/or secondary air 39 delivered through the runners 24 is sufficient to maintain operation of the internal combustion engine 15 at low speeds regardless of the operation of the throttle valve 32.

In some modes of operation, the idle regulating valve 40 is opened and the throttle valve 32 is then moved from a closed position to an open position, the idle regulating valve 40 can close as the negative pressure in the surge tank 26 is reduced.

Although the description has been made based on the illustrated embodiment, the internal combustion engine 15 may be a two-cycle engine having a carburetor, instead of the fuel injection system 64. The mounting boss 48 of the surge tank 26 may be located at the center of the surge tank 26 in the vertical direction. The secondary air 39 supplied from the idle regulating valve 40 can be distributed throughout the chamber 28 in the surge tank 26 and then into the intake runners 24.

A skilled artisan will recognize the interchangeability of various features from different embodiments disclosed herein. Similarly, the various features and steps discussed above, as well as other known equivalents for each such feature or step, can be mixed and matched by one of ordinary skill in this art to perform methods in accordance with principles described herein. Additionally, the methods which are described and illustrated herein are not limited to the exact sequence of acts described, nor are they necessarily limited to the practice of all of the acts set forth. Other sequences of events or acts, or less than all of the events, or simultaneous occurrence of the events, may be utilized in practicing the embodiments of the invention.

Although the invention has been disclosed in the context of certain embodiments and examples, it will be understood by those skilled in the art that the invention extends beyond the specifically disclosed embodiments to other alternative embodiments and/or uses and obvious modifications and equivalents thereof. For example, the engine 15 can be used with other types of marine drives (i.e., inboard motors, inboard/outboard motors, jet drives, etc.) and also certain land vehicles. Furthermore, the engine 15 can be used as a stationary engine (e.g., a generator) for some applications as will be apparent to those of ordinary skill in the art in light of the description herein. In any of these applications, the engine 15 can be oriented vertically, horizontally or otherwise disposed. Accordingly, it is not intended that the invention be limited, except as by the appended claims.

What is claimed is:

1. An outboard motor comprising a multi-cylinder internal combustion engine having combustion chambers each being defined by a cylinder head, piston, and cylinder bore, an air intake manifold configured to introduce primary air and secondary air from the atmosphere into the internal combustion engine, the air intake manifold having a plurality of intake runners located next to one side of the internal combustion engine and extending from the cylinder head to a surge tank, and an idle regulating valve arranged to supply secondary air from the atmosphere to the surge tank, the idle regulating valve comprising an air intake port configured to receive secondary air and an air supply port arranged to supply the secondary air from the idle regulating valve to the surge tank, at least a portion of the idle regulating valve being positioned in a space between the internal combustion engine and the air intake manifold, and the air supply port of the idle regulating valve opening directly into the surge tank.

2. The outboard motor of claim 1, wherein the air intake port opens into the space between the internal combustion engine and the air intake manifold.

3. The outboard motor of claim 1, wherein the air supply port is formed in a portion of the surge tank between upstream ends of two adjacent vertically aligned intake runners.

4. The outboard motor of claim 1, further comprising a sensor mounted to an upper portion of the surge tank, the sensor being positioned and configured to detect the intake air pressure within the air intake manifold, and the idle regulating valve being configured to operate based on a signal from the sensor.

5. The outboard motor of claim 4, wherein the surge tank comprises a surge tank opening configured to receive air from a throttle valve, and the sensor is positioned above the uppermost runner and the surge tank opening.

6. The outboard motor of claim 1, further comprising a throttle valve and silencer positioned upstream of the air intake manifold.

7. The outboard motor of claim 1, wherein the idle regulating valve is positioned next to a side of the internal combustion engine.

8. The outboard motor of claim 1, wherein the idle regulating valve is generally surrounded by the internal combustion engine and the air intake manifold.

9. The outboard motor of claim 1, further comprising a mounting boss being positioned near an upstream opening of the surge tank and forming at least a portion of the air supply port, and the idle regulating valve being mounted to the mounting boss.

10. The outboard motor of claim 1, further comprising a mounting boss being positioned between an upstream opening of the surge tank and a bottommost pair of intake runners and forming at least a portion of the air supply port, and the idle regulating valve being mounted to the mounting boss.

11. An outboard motor comprising an internal combustion engine, an air intake system including an air intake manifold having a surge tank and a plurality of intake runners, the intake runners positioned adjacent to the internal combustion engine and extending from the surge tank toward corresponding combustion chambers of the internal combustion engine, and an idle regulating valve in fluid communication with the air intake manifold, the idle regulating valve comprising an air intake port configured to receive secondary air and an air supply port arranged to deliver secondary air to the air intake manifold, at least a portion of the idle regulating valve being interposed between the internal combustion engine and the air intake manifold, and the air intake port opening into a space defined between the internal combustion engine and the air intake manifold.

12. The outboard motor of claim 11, wherein the idle regulating valve is positioned generally midway along a generally vertical side wall of the combustion engine.

13. The outboard motor of claim 11, wherein the idle regulating valve is mounted to a side of the combustion engine.

14. The outboard motor of claim 11, wherein the idle regulating valve is mounted to the air intake manifold.

15. The outboard motor of claim 11, wherein the air intake port opens downwardly into the space.

16. The outboard motor of claim 11, further comprising a sensor adapted to produce a detection signal, and the sensor being attached to the surge tank.

17. The outboard motor of claim 16, wherein the sensor measures a pressure within the air intake manifold and sends a detection signal based on the pressure to an ECU, and the ECU selectively controls the idle regulating valve in response to the detection signal.

18. The outboard motor of claim 11, wherein the air intake system further comprises a throttle valve and a silencer positioned upstream of the air intake manifold.

19. The outboard motor of claim 11, wherein a substantial portion of the idle regulating valve is positioned in a space defined between an engine body defining the combustion chambers of the internal combustion engine and the air intake manifold.

20. The outboard motor of claim 11, wherein the idle regulating valve is vertically positioned between two runners.

21. The outboard motor of claim 11, wherein the idle regulating valve mounted to the surge tank and positioned vertically between upstream ends of a bottommost pair of runners.

22. The outboard motor of claim 11, wherein the internal combustion engine and the air intake manifold extend upwardly and downwardly past the idle regulating valve.

* * * * *